US006626333B2

(12) United States Patent
Levesque et al.

(10) Patent No.: US 6,626,333 B2
(45) Date of Patent: Sep. 30, 2003

(54) BOTTLE-CONNECTOR

(76) Inventors: Michel Gilbert Levesque, 523 Gaylord Dr., Oshawa, Ontario (CA), L1K 1L4; Madison Clova Levesque, 523 Gaylord Dr., Oshawa, Ontario (CA), L1K 1L4

( * ) Notice: Subject to any disclaimer, the term of this patent is extended or adjusted under 35 U.S.C. 154(b) by 12 days.

(21) Appl. No.: 09/903,691

(22) Filed: Jul. 13, 2001

(65) Prior Publication Data

US 2002/0005418 A1 Jan. 17, 2002

(30) Foreign Application Priority Data

Jul. 14, 2000 (CA) ..... 2313926

(51) Int. Cl.[7] ..... A45F 3/16

(52) U.S. Cl. ..... 224/148.6; 224/148.4; 224/251; 224/269; 215/399

(58) Field of Search ..... 224/148.1, 148.4, 224/148.6, 148.7, 600, 605, 616, 617, 251, 269; 215/395, 399

(56) References Cited

U.S. PATENT DOCUMENTS 3,977,638 A * 8/1976 Woodard ..... 224/148.6
4,096,977 A * 6/1978 Barville et al. ..... 224/148.6
5,167,356 A * 12/1992 Williams ..... 206/8
5,664,712 A * 9/1997 Smrt ..... 224/250
5,810,218 A * 9/1998 Falcaro ..... 224/148.1
5,954,247 A * 9/1999 Savine et al. ..... 215/399
5,971,238 A * 10/1999 Malvasi et al. ..... 224/148.6
6,131,780 A * 10/2000 Becker ..... 224/148.6
6,283,346 B1 * 9/2001 Thomas ..... 215/396

* cited by examiner

*Primary Examiner*—Stephen K. Cronin

(57) ABSTRACT

The bottle-connector connects a bottle to an individual, back-pack or clothing. The bottle is of the type having a neck in which an annular groove or ridge is formed. The connector has a resilient O-ring having an opening in which the neck is received. A collar is provided for adjusting the opening to an effective size such that the O-ring is snugly accommodated in the groove where the bottle has a groove or to an effective size smaller than the outer diameter of said ridge where the bottle has a ridge such that the O-ring is securely connected to the bottle. The connector also has a rigid ring connected to the O-ring and a strap or clip for connecting the rigid ring to the individual or to his back-pack or clothing.

5 Claims, 3 Drawing Sheets

BOTTLE-CONNECTOR

BACKGROUND OF THE INVENTION

This invention relates to connectors and more particularly to a bottle-connector for attaching a bottle in a location convenient to an individual Individuals engaged in physical activities such as walking, jogging and cycling frequently carry bottles containing water, fruit juice or soft drinks. The bottles may be carried in their hands, in back-packs or on the frames or handle bars of their bicycles. The bottles can be a nuisance if they are held by hand. If they are in a back-pack or attached to a bicycle they may not be convenient to reach.

DESCRIPTION OF THE INVENTION

The bottle-connector of the subject invention overcomes such problems. The bottle may be conveniently located on an individual's wrist, around his neck or elsewhere to his body or to a back-pack. It may also be attached to his clothing. The bottle is not held in the individual's hand unless he wishes to drink from it and therefore the bottle does not interfere with the activity in which he is engaged unless he is actually drinking from the bottle.

As indicated, the bottle-connector of the invention serves to attach a bottle to an individual's body or to the apparel worn by him. The bottle is of the type which has a neck in which an annular ridge or groove is formed. The bottle-connector includes an elastic O-ring adapted to be snugly fitted in the groove or adjacent to the ridge and to be removable therefrom by causing resilient expansion of the O-ring sufficient to allow such removal. A link in the form of a rigid ring is connected to the O-ring and the rigid ring is attached to the clothing of the individual, a back-pack or around his body by connecting means.

Briefly the bottle-connector of the invention is adapted to connect a bottle in a location convenient to an individual. The bottle is of the type having a neck in which an annular groove or ridge is formed. The bottle-connector includes: a resilient O-ring having a first opening in which the neck is adapted to be received; means for adjusting the first opening to an effective size such that the O-ring is snugly accommodated within the groove where the bottle has an annular groove or to an effective size smaller than the outer diameter of the ridge where the bottle has an annular ridge such that the O-ring is securely connected to the bottle. The connector also has a link connected to the O-ring and means for connecting the link in the location.

DESCRIPTION OF THE DRAWINGS

The bottle-connector of the invention is described with reference to the accompanying drawings in which.

Like reference characters refer to like parts throughout the description of the drawings.

DESCRIPTION OF PREFERRED EMBODIMENTS

Figure 1:
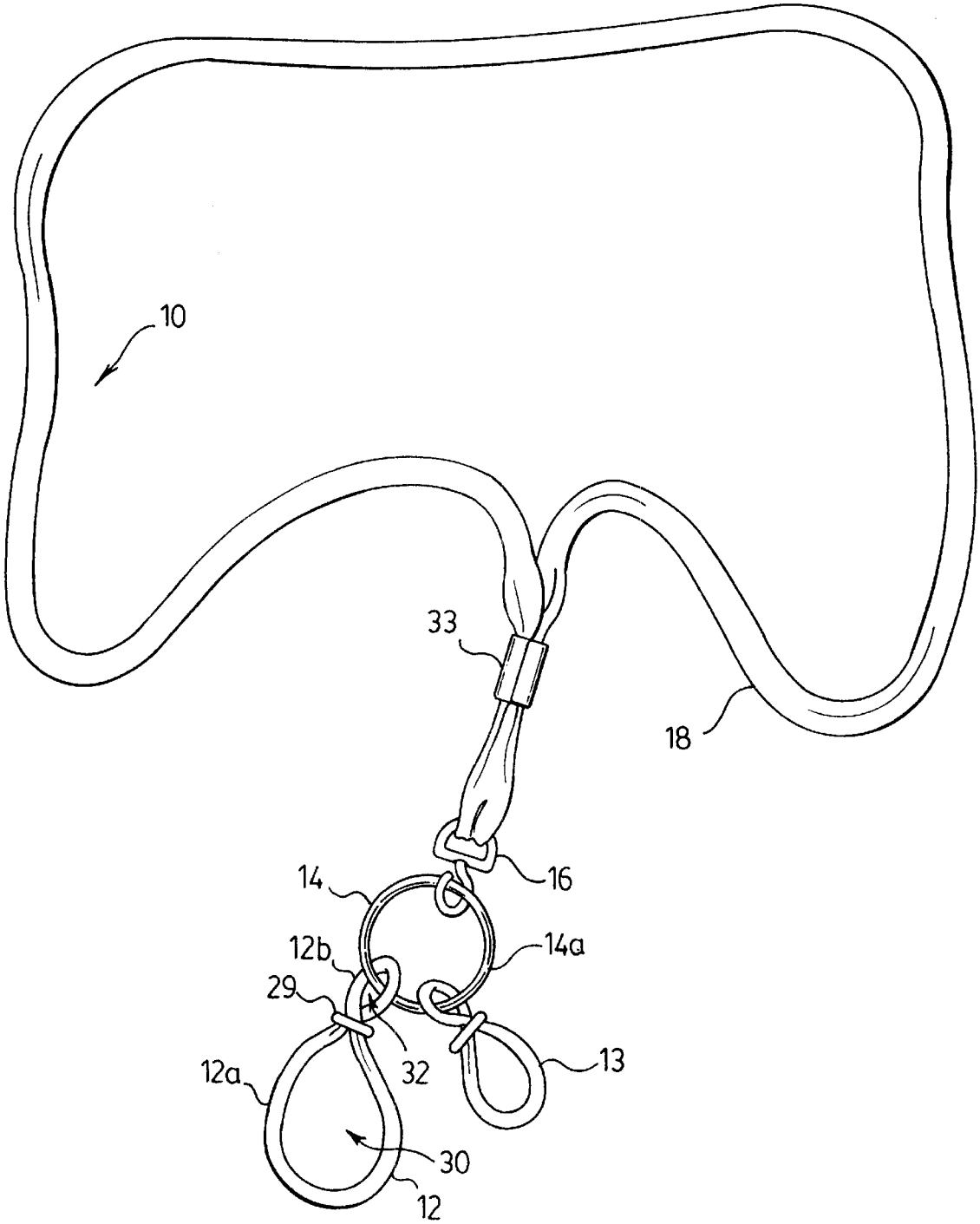
FIG. 1 is a perspective view of the connector.

With reference to FIG. 1, the bottle-connector of the invention, generally 10, includes two O-rings 12, 13, a link in the form of a rigid ring 14, a swivel 16 and a strap 18. The two O-rings are of the same construction and only one, 12 is described below.

Figure 2:
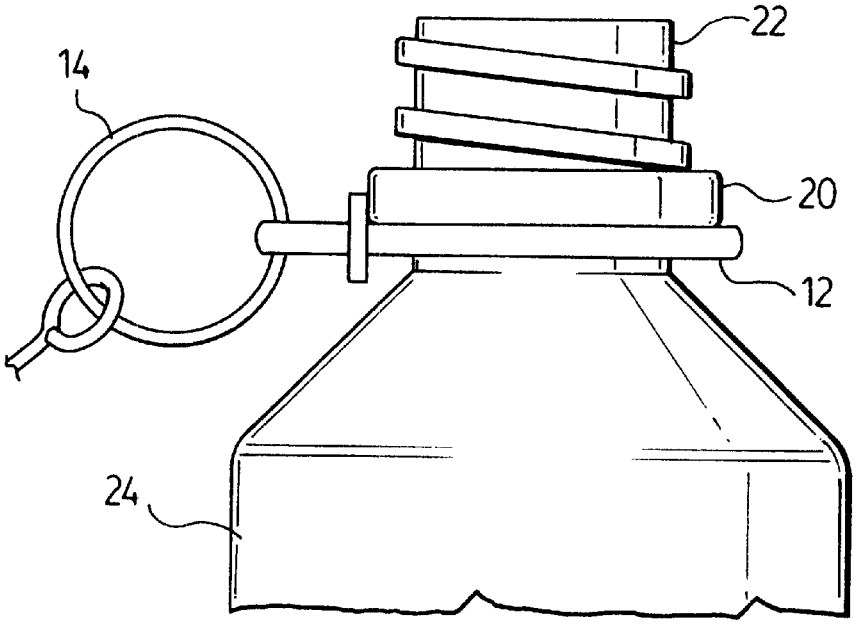
FIG. 2 is an elevation of a portion of a bottle and connector.

With reference to FIG. 2, O-ring 12, as is conventional, is composed of elastic material such as plastic or rubber and deforms resiliently until it rests adjacent to annular ridge 20 formed in the neck 22 of bottle 24. As illustrated, the ring is located beneath the ridge when the bottle is upright so that the ridge prevents the ring from separating from the bottle.

Figure 3:
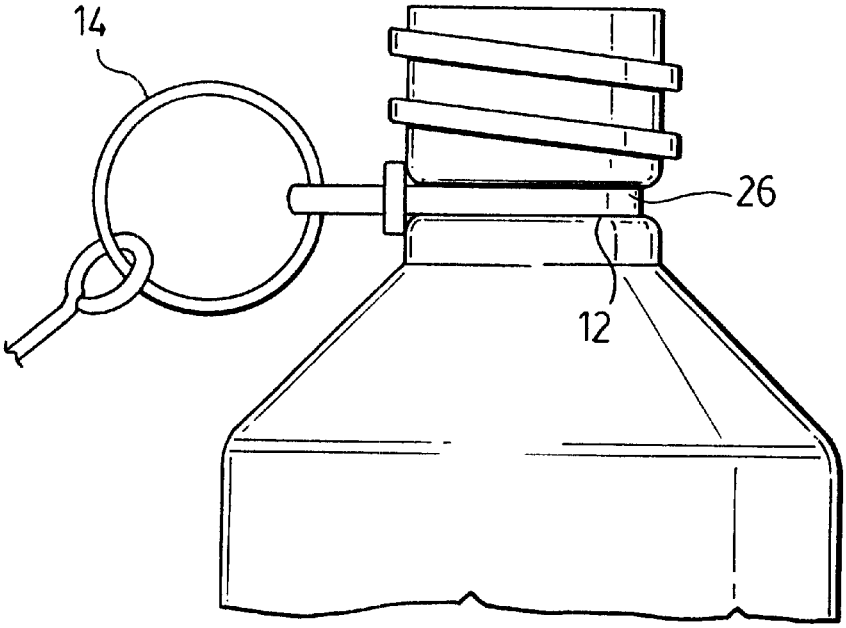
FIG. 3 is a side view of a portion of the neck of a different form of bottle.

The bottle may alternatively have an annular groove 26 in its neck as illustrated in FIG. 3 in which case the O-ring will fit into the groove.

Bottles having annular ridges or grooves formed on or in their necks such as illustrated in FIGS. 2 and 3 are well known and are widely available.

Preferably bottles carried by the bottle-connector of the invention are constructed of plastic or other material which do not shatter when subject to impact. Bottles constructed of glass or other material which shatter on impact are generally not recommended to be carried by the bottle-connector. The reason is that the bottle-connector will typically be used to carry a bottle to refresh an individual when he is engaged in physical activity such as walking, jogging, or riding a bicycle. During such activity the bottle may strike the individual or the bicycle if he is riding on one. If the bottle is of glass it may break upon such impact and cause injury.

The O-ring may be removed from ridge 20 or groove 26 simply by pulling the rigid ring 14 upwardly thereby causing the O-ring to deform resiliently and to enlarge sufficiently to allow the O-ring to be removed.

With reference again to FIG. 1, rigid ring 14 is preferably a so-called "key ring" in the form of an elongated resilient spiral shaped wire having ends (one illustrated and marked 14*a*) which are adjacent to the intermediate portion of the wire. The O-ring may be attached to the rigid ring in typical fashion simply by separating the end from the intermediate portion sufficiently to allow the O-ring to pass through the space.

An adjusting means or locking collar 29 extends around the O-ring and divides the O-ring into two circular segments 12*a, b*, the former of which is received in the groove or adjacent to the ridge of the bottle and other of which receives the rigid ring 14.

Within segment 12*a* is a first opening 30 and within segment 12*b* is a second opening 32. The locking collar is movable along the O-ring with resulting adjustment in the effective size of the first opening. The collar thus enables the O-ring to be adjusted snugly within the groove or ridge. The collar tightly contacts the O-ring such that the collar moves along the O-ring only upon application of a relatively large force.

Swivel 16 connects the rigid ring 14 to the strap 18 and is of conventional construction. The swivel allows the rigid ring to rotate without turning the strap. The strap likewise is of conventional construction and is sufficiently flexible and soft that it can be comfortably worn by the individual around a part of his body, typically his neck, wrist or even his leg. A ferrule 33 ensures that the swivel does not move on the strap.

Figure 4:
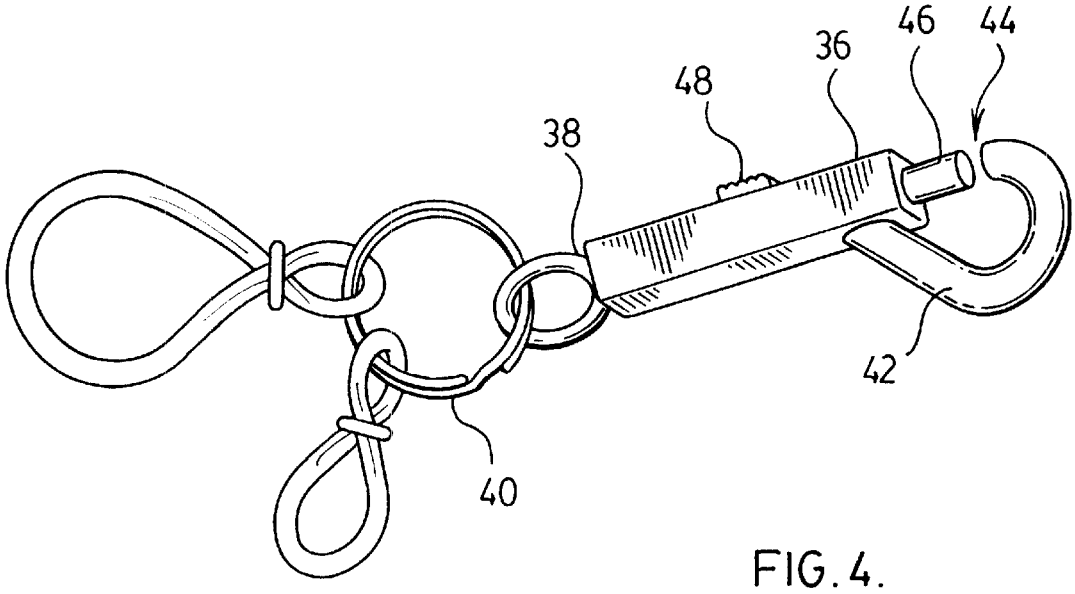
FIG. 4 is a perspective view of a second embodiment of the connector.

With reference to FIG. 4, the bottle-connector differs from the connector illustrated in FIG. 1 in that strap 18 has been replaced by a spring-loaded clip 36. The clip is of conventional construction having a swivel 38 at one end which interconnects the clip and rigid ring 40. At the opposite end of the clip a hook 42 is formed. The hook has an opening at its mouth 44 which is closed by latching means in the form of rod 46. The rod is retractable and is received in the body of the clip. The rod is biased closed by a coil spring (not illustrated) within the clip body. The rod is connected to a handle 48 so that the rod may be opened to allow the hook to be attached to an individual's apparel such as a belt loop or to a back-pack, pocket or purse.

It will be understood of course that modifications can be made in the bottle-connector of the invention without departing from the scope and purview of the invention as defined in the appended claims.

We claim:

1. A connector adapted to connect a bottle in a location convenient to an individual, said bottle being of the type having a neck in which an annular groove or ridge is formed, said connector including:

a resilient O-ring having a first opening in which said neck is adapted to be received;

means for adjusting said first opening to an effective size such that said O-ring is snugly accommodated within said groove where said bottle has an annular groove or to be an effective size smaller than the outer diameter of said ridge where said bottle has an annular ridge such that said O-ring is securely connected to said bottle;

said adjusting means is a locking collar which extends around said O-ring and separates said O-ring into two segments, one of which defines said first opening and the other of which defines a second opening through which said link passes, said locking collar being movable along said O-ring with resulting adjustment in the effective size of said first opening;

a link connected to said O-ring; and means for connecting said link in said location.

2. The connector as claimed in claim 1 wherein said locking collar tightly contacts said O-ring such that said collar moves along said O-ring only upon application of force.

3. The connector as claimed in claim 2 wherein said link is an elongated resilient spiral having a pair of ends and an intermediate portion which extends therebetween, one said end being in contact with said intermediate portion but being separable therefrom by the application of a force opposed to the bias of said resilient spiral to permit said connecting means to be selectively attached to and removed from said link.

4. The connector as claimed in claim 3 wherein said connecting means is a strap.

5. The connector as claimed in claim 3 wherein said connecting means is a clip having a swivel which is connected to said link, said connecting means further having a hook for maintaining said connecting means at said location, said hook having an opening; latching means for selectively closing said opening; and resilient means for biasing said latching means closed.

* * * * *